United States Patent [19]

Edwards et al.

[11] Patent Number: 4,861,021

[45] Date of Patent: Aug. 29, 1989

[54] SAFETY HARNESS ON/OFF SWITCH ASSEMBLY FOR TREADMILLS

[75] Inventors: Marysue Edwards, Grand Blanc; Max M. Dubrinsky, West Bloomfield, both of Mich.

[73] Assignee: Safe/Stress, Inc., Grand Blanc, Mich.

[21] Appl. No.: 121,924

[22] Filed: Nov. 18, 1987

[51] Int. Cl.[4] ..... A63B 23/06

[52] U.S. Cl. ..... 272/69; 272/70

[58] Field of Search ..... 272/69, 70, 70 A, 143, 272/144, 93; 128/25 R; 340/636

[56] References Cited

U.S. PATENT DOCUMENTS

| | | | |
|---|---|---|---|
| 3,408,067 | 10/1968 | Armstrong | 272/97 |
| 3,761,082 | 9/1973 | Barthel, Jr. | 272/70 A |
| 4,228,427 | 10/1980 | Niedermeyer | 340/636 |
| 4,364,556 | 12/1982 | Otte | 272/69 |
| 4,410,175 | 10/1983 | Shamp | 272/70 |
| 4,545,575 | 10/1985 | Forjot | 272/97 |
| 4,655,447 | 4/1987 | Dubrinsky et al. | 272/69 |

FOREIGN PATENT DOCUMENTS

| | | | |
|---|---|---|---|
| 9426 | of 1909 | United Kingdom | 272/70 A |

*Primary Examiner*—S. R. Crow

*Attorney, Agent, or Firm*—Dykema Gossett

[57] ABSTRACT

A safety harness on/off switch assembly for a motorized treadmill comprises a support positioned over the treadmill, and a safety harness including a pair of spaced laterally interconnected straps at their upper ends yieldably and flexibly suspended from the support and at their lower ends including a pair of loops to receive portions of the body of a user upon the treadmill. A normally closed safety switch is mounted upon the support and is located in the electrical circuit of the treadmill. When the user faints, falls, or trips, or is injured, his or her body rests upon the straps and opens the safety switch thereby automatically shutting down the motorized treadmill.

7 Claims, 4 Drawing Sheets

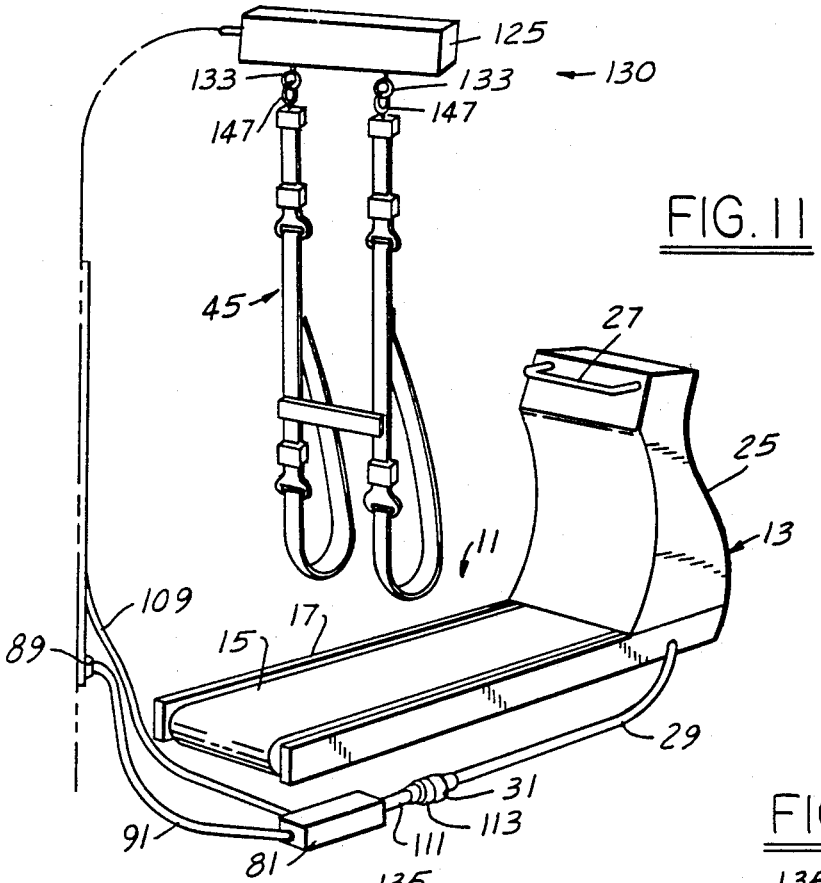
FIG. 11
FIG. 12
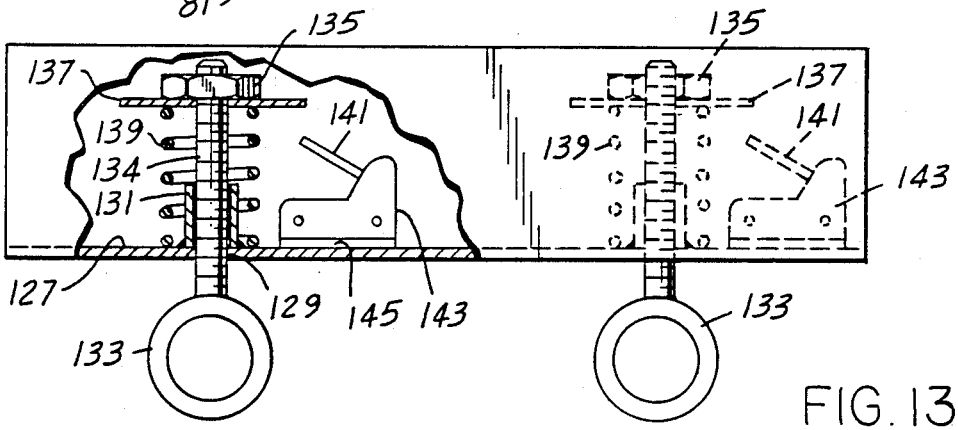
FIG. 13
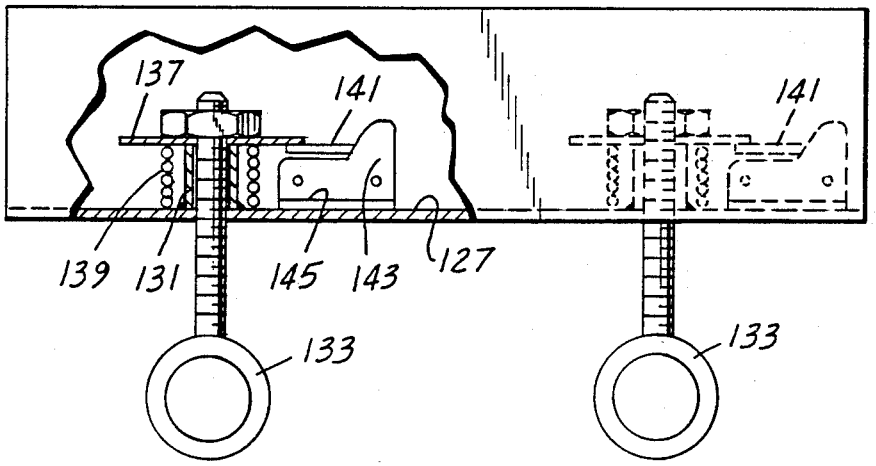

SAFETY HARNESS ON/OFF SWITCH ASSEMBLY FOR TREADMILLS

FIELD OF INVENTION

The present invention relates to motorized treadmills and more particularly to a safety harness worn by the user so that if the user faints, falls, trips or is injured, the weight of his or her body upon the harness opens a safety switch to automatically shut down the treadmill.

RELATED PATENTS

The present Applicants are the owners of U.S. Pat. No. 4,655,447 dated Apr. 7, 1987 and No. 4,687,196 dated Aug. 18, 1987, each patent relating to a treadmill assembly.

BACKGROUND OF THE INVENTION

Previously during cardiac testing, rigorous regime or routine physical exercises, individuals are at risk of falling, tripping, fainting or other injury. The disclosure of the above cited United States Patents provide a safety stress harness for a treadmill which during normal operation loosely receives portions of the body of the user and in the event of falling tends to catch and protectibly support the body against injury which might occur if the user fell to the ground or upon some portion of the treadmill.

Previously in the use of the safety harnesses such as disclosed in the foregoing recited patents the user was supported to some extent against falling, fainting or injury; however, the treadmill continues to drive under the user until it is turned off by supervisory personnel. For any person who has collapsed or has fallen into the harness with feet resting upon a moving treadmill, there is still the danger of falling over or outwardly of the harness due to the continued movement of the treadmill belt until the treadmill is disconnected.

SUMMARY OF THE INVENTION

An important feature of the present invention is to provide an automatic electrical safety switch circuit for a treadmill which, in the event that a user faints, falls or trips or is injured while using the treadmill, there is provided a safety switch assembly connected with the safety harness such that upon such falling the weight of the users body acting through the harness is effective to electrically deactivate the treadmill and shut it down.

Another feature is to provide a safety harness on/off switch assembly for a motorized treadmill together with a support means positioned over the treadmill supporting a safety harness. The harness includes a pair of spaced straps at their upper ends flexibly and yieldably suspended from the support means and at their lower ends includes a pair of loops to loosely receive portions of the body of the user upon the treadmill. An electrical circuit is connected to the treadmill that includes a normally closed safety kill switch mounted upon the support, interconnected in the circuit and including a movable member. A control means is connected to at least one of the straps and upon downward movement is adapted to retract the movable member upon the kill switch breaking the electrical circuit and deactivating the treadmill if the user falls, trips, faints or is injured.

Still another feature is to provide safety kill switch which is mounted upon a support means and which includes a retractable pull trap pin together with a control means which is connected to one of the straps so that upon downward movement under the weight of the user is adapted to retract the pull trap pin breaking the electrical circuit and deactivating the treadmill.

As a further feature of the present invention, the treadmill includes an electric motor connected into the electrical circuit whereby when the pull trap pin is retracted the electric motor is deactivated shutting down the treadmill.

As a still further feature, the support means includes a tubular support adapted for connection to a ceiling having a pair of laterally spaced tubular extensions depending therefrom mounting transverse support bolts, with the upper ends of the straps of the safety harness extending into the extensions and being flexibly connected thereto.

Another feature is that the straps of the safety harness include a friction retained pleat therein including a plurality of reverse turned overlapping folds in the straps together with spring clips extending over and retaining the folds. With such a construction should the user faint or fall, the weight of the user upon the straps extends the straps, disengages the spring clips and releases the pleats. The resulting lengthening of the straps opens the safety switch to deactivate the electrical circuit to the treadmill.

As still another feature, the safety harness includes control means in the form of a cord which interconnects the pull trap pin and at least one of the straps whereby when the user falls, trips, faints or is injured the body of the user rests upon the loops of the straps extending the straps, retracting the cord and correspondingly retracting the pull trap pin to deactivate the treadmill.

As a further feature, the present safety harness on/off switch assembly includes an assembly box which protectively encloses a relay switch, a transformer and electrical circuitry together with a plurality of electrical conduits adapted for connection to a power source, connection to the motor of the treadmill and for connection to the safety switch controlling operation of the treadmill.

As a still further feature, the safety switch mechanism may be a pair of normally closed micro switches, each including a movable member positioned within the support. The respective straps of the harness are yieldably suspended at their one ends within the support. A movable contact member is provided on one strap so that if the user faints, falls or trips and his weight is applied to the straps, the straps will be extended and the contact member will engage the movable member of the micro switches opening the electrical circuit to the power operated treadmill thereby deactivating the same.

These and other objects and features will be seen from the following specification and claims in conjunction with the appended drawings.

THE DRAWINGS

FIG. 1 a front perspective view of the present safety harness on/off switch assembly for a motorized treadmill.

FIG. 11 is a front perspective view of the safety harness assembly for a treadmill showing an alternative ceiling mount for the safety harness.

FIG. 12 is a front elevational view, partly broken away and sectioned, of the ceiling mount housing of FIG. 11, illustrating the yieldable strap mounts for the straps of the safety harness and associated micro switches, when the harness is in a use position, and on an increased scale.

FIG. 13 is a similar view to FIG. 12, with the yieldable strap mounts for the harness in an extended position caused by the weight of the user extending the straps to activate the strap mounts to thereby open the corresponding micro switches.

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Figure 1:
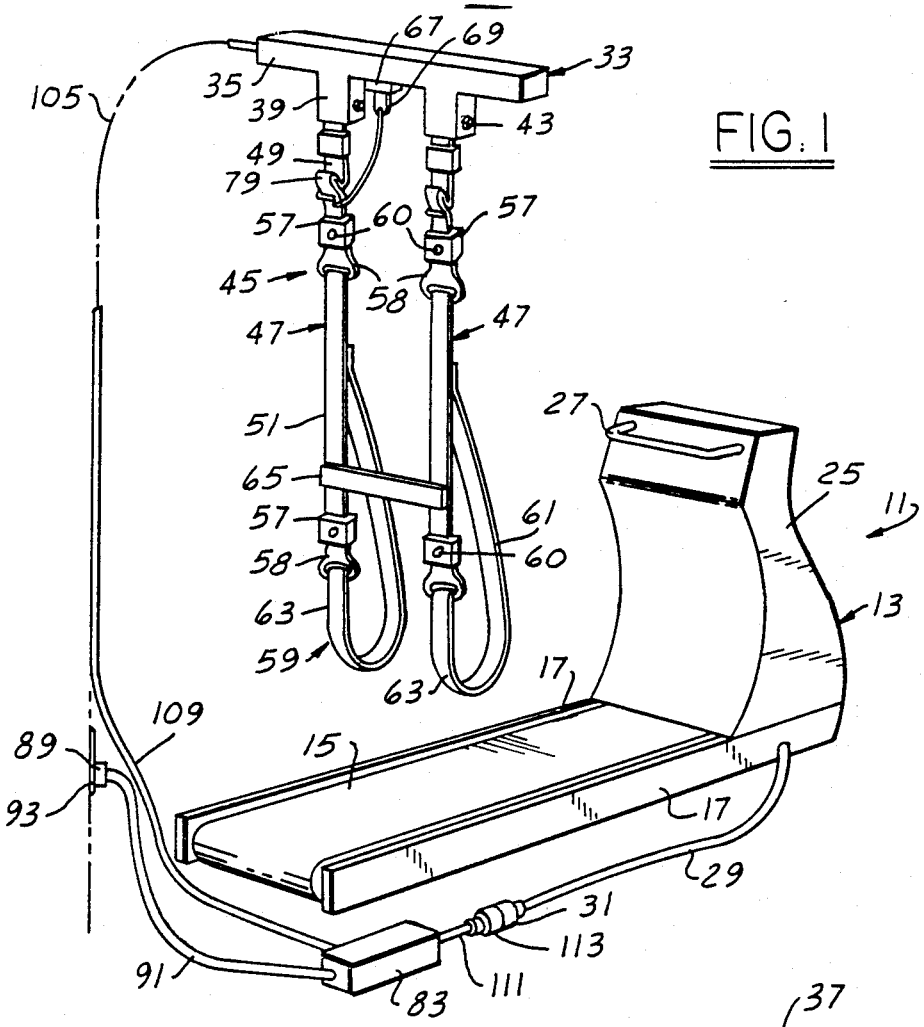

Referring to the drawings, FIGS. 1 through 10, a motorized treadmill assembly is generally indicated at 11, FIG. 1, including a frame or base 13 and a power driven endless belt 15 located between a pair of opposed spaced side rails 17. Belt 15 is in the form of a continuous loop which is driven by a variable speed electric motor 19, FIGS. 2, 3 and 7. Drive roller 21 is connected to the motor 19 and supports one end of the belt 15. Idler roller 23 supports the opposite end of the belt 15, with both rollers 21 and 23 being journaled upon the frame 13 and between the side rails 17.

Figure 2:
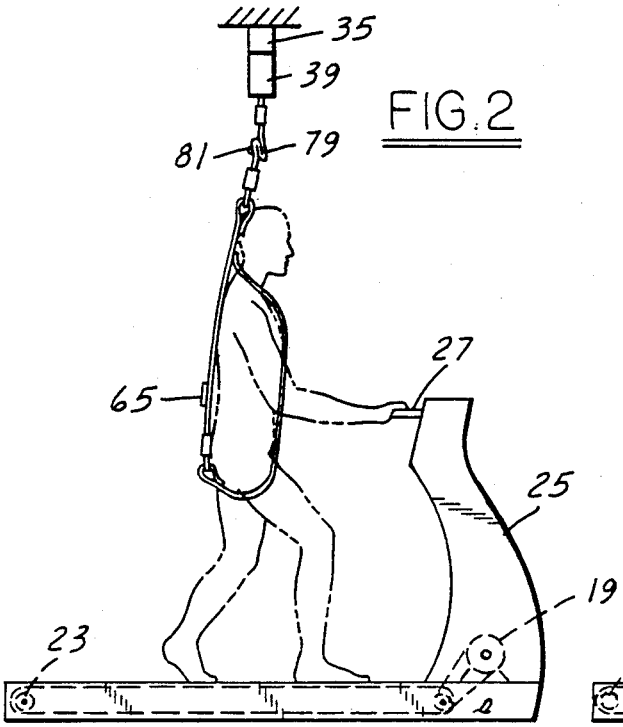
FIG. 2 is a fragmentary side elevational view from the right side of the treadmill shown in FIG. 1, with the harness in a normal use position.
Figure 3:
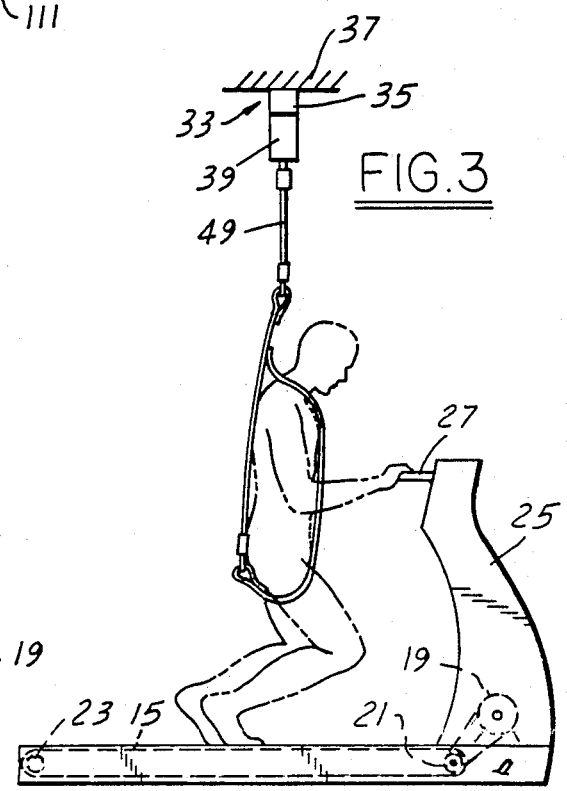
FIG. 3 is a similar view to FIG. 2, with the harness extended to operate the safety switch mechanism to deactivate the treadmill.

The present frame or base 13 includes the upright pedestal 25 at the forward end thereof within which is housed the electric motor 19. Across the rear face of an upper portion of the pedestal 25 is a U shaped handle 27 for providing assistance to the user, such as shown in FIGS. 2 and 3. Power conduit 29 is connected to motor 19 and at one end has a male socket 31 connectible to the female power socket 113, FIG. 1.

An overhead support means is generally indicated at 33, FIG. 1, normally spaced above treadmill 11, and in the illustrative embodiment includes the elongated tubular support 35 which is suitably secured to ceiling 37, FIGS. 2 and 3. A pair of longitudinally spaced extension arms 39 depend from support 35. A pair of transverse harness support bolts 41 extend across the extension arms 39 and are secured thereto by nuts 43.

The safety harness generally designated at 45, includes a pair of laterally spaced straps 47, made of a suitable fabric similar to seat belt material. Each strap includes an upper strap portion 49 and a lower strap portion 51. Each strap upper portion 49 terminates in the loop 53 which extends over a portion of S hook 55 which is located within extension arm 39. The upper portion of S hook 55 extends over and is supported upon the transverse harness support bolt 41, FIGS. 4 and 5. The strap upper portion 49 includes the adjustable female seat belt or locking member 57 providing a means for shortening or lengthening upper portion 49 in a conventional manner. The lower portion 51 of each strap 47 terminates in a loop 59. Each loop 59 includes a front section 61 and a rear section 63, adapted to receive portions of the body of the user, FIGS. 2 and 3. Straps 47 are laterally interconnected at the loop rear strap portions 63 by the transverse catch band 65 which at its ends is suitably secured as by stitching to the corresponding rear portion of loops 59.

Male seat belt or locking members 58 located at the upper ends of the lower strap portions 51 and rear strap portions 63 of loops 59 cooperatively nest and lock within the corresponding female locking members. The female locking members 57 are each provided with a quick release button 60, FIG. 1. When a user has fainted or fallen and has stressed the safety harness 45 which is supporting the body of the user, the quick release button(s) 60 when actuated quickly disengages the user from the harness 45. The lower female locking members 57 located within loops 59 of the safety harness provide a means for lengthening or shortening the extent of the supporting loops 59 to fit the body of the user. The construction of the safety harness 45 is set forth in Applicants U.S. Pat. No. 4,655,447 and 4,867,196.

A safety kill switch 67, sometimes referred to as safety switch means, is secured to and depends from the support 35. Switch 67 is located between extension arms 39 and includes the depending retractable insulated pull trap pin 69. The flexible cord 71 at one end is connected to the pull trap pin 69 at 73, FIG. 4, and at its other end is connected by the eyelet 75 to the upper portion 49 of one of the straps 47.

Figure 4:
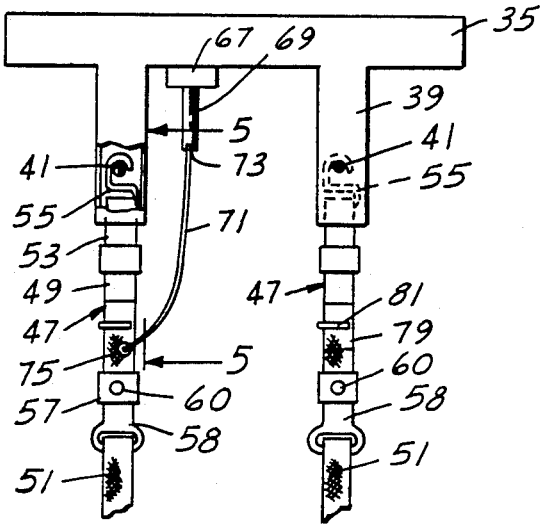
FIG. 4 is a fragmentary front elevation view of the ceiling support and a portion of the harness shown in FIG. 1, on an increased scale.
Figure 5:
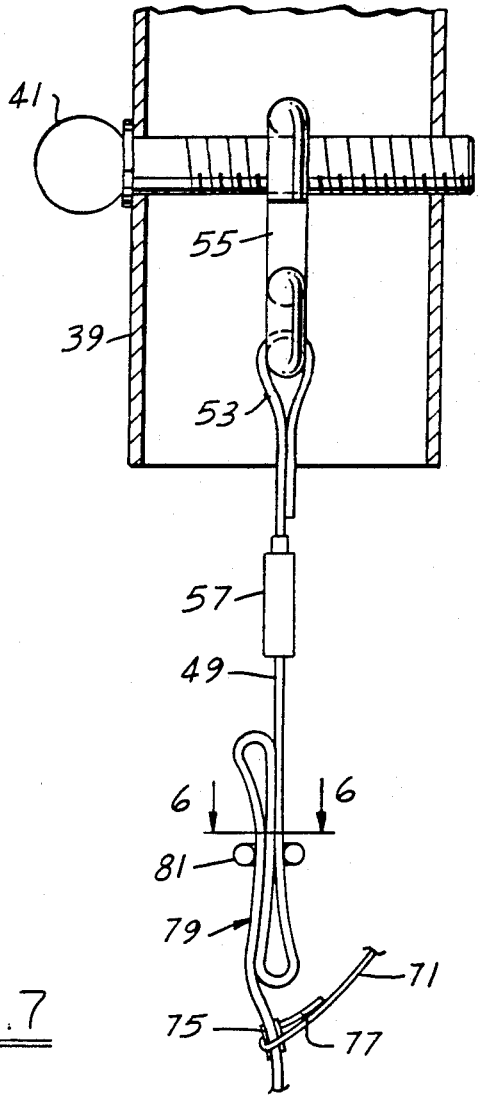
FIG. 5 is a fragmentary sectional view taken in the direction of arrows 5—5 of FIG. 4, on an increased scale.
Figure 6:
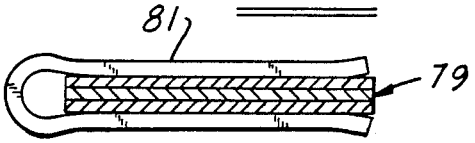
FIG. 6 is a fragmentary sectional view taken in the direction of arrows 6—6 of FIG. 5, on an increased scale.

The respective straps 47 in normal operation are shortened by employing a pair of reversed turned pleats 79, or pleated portions as shown in FIGS. 4, 5 and 6. The pleats 79 include a series of folded over portions which are in engagement and held together by the removable spring clip 81. In operation, in the event that the user upon the treadmill stumbles, faints, falls or is otherwise hurt and applies his body weight to safety harness 45, the weight of the user extends the respective straps 47 which are otherwise flexibly and yieldably suspended from the support 35, FIG. 3.

The downward forces upon the safety harness 45, and particularly upon the straps 47, automatically disengage the spring clips 81 from the straps so that the straps are unpleated and extend downwardly thereby placing tension upon the cord 71. This retracts the pull trap pin 69 to thereby open the normally closed safety kill switch 67.

Figure 7:
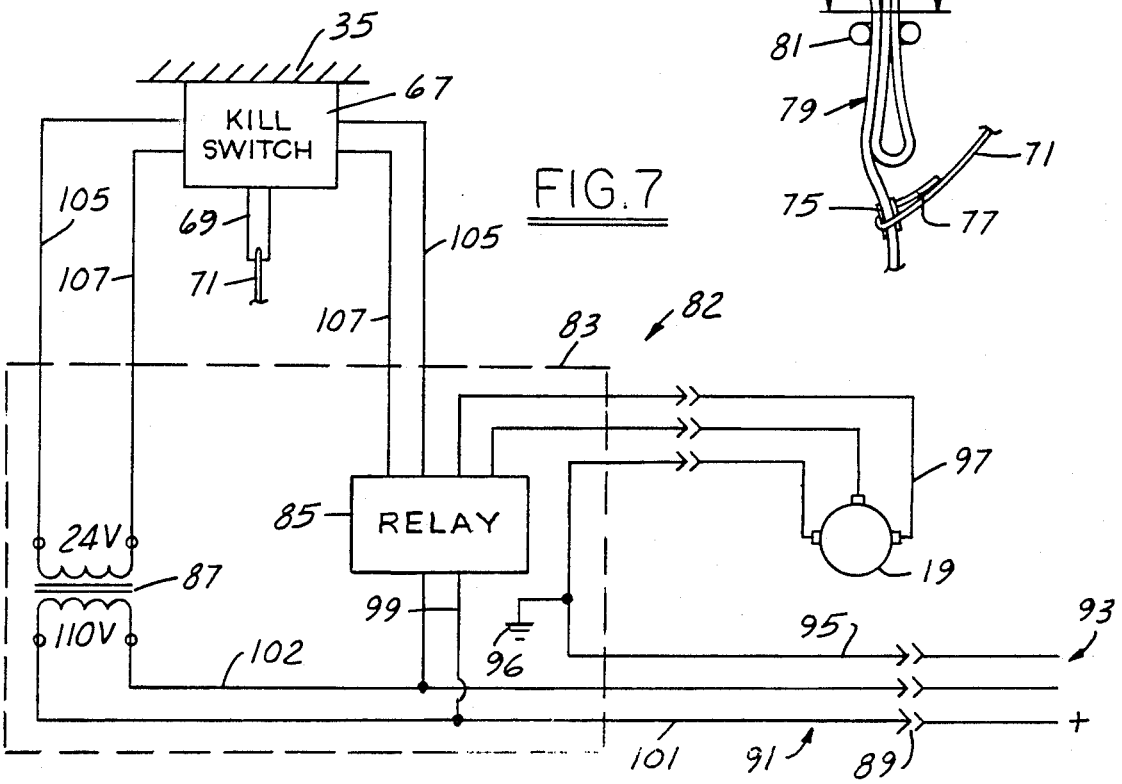
FIG. 7 is a schematic electrical diagram illustrating the safety circuit for the switch assembly.

The shut off box 83, FIG. 1, is shown in phantom lines in FIG. 7 and is a part of the electrical circuit 82 which includes the normally open relay switch 85. The relay switch 85 has a conventional magnetic coil which when energized closes the relay switch for delivering electrical power to the treadmill motor 19.

The electrical circuit 82 includes a step down transformer 87 which includes a high voltage coil at 220 volts or 110 volts, selectively and a low voltage coil, such as the 24 volt coil as shown in FIG. 7. The male plug 89 located upon one end of the electric conduit 91, FIGS. 1 and 7, is adapted to plug into the electrical power source 93 which selectively may be 220 volts or 110 volts matching the high side of the selected transformer 87.

One electrical lead 101, FIG. 7, from power source 93 extends through the interconnected conduits 111 and 29 of FIG. 1 for connection to the treadmill motor 19, FIG. 7. Lead 97 connects one terminal on the relay switch 85 to the motor 19. Another terminal or relay switch 85 connects lead 99 and lead 101 thereby completing the circuit 82 from the power source 93. The power lead 101 from the power source 93 is directly connected to one side of the primary transformer 87. The other side of the transformer is connected through lead 102 to the power source 93.

Lead 105 connects one side of the secondary windings of the transformer 87 to the kill switch 67, FIG. 7 and a terminal of relay switch 85. Lead 107 connects a terminal of relay switch 85, through the kill switch 67, to the other side of the secondary winding of transformer to complete the circuit.

In operation, the secondary winding or coil of transformer 87 energizes the normally opened kill switch 67 and directs low voltage current to the magnetic coil located within relay switch 85 causing and thereby closing the normally open relay switch 85. This results in completing the electrical circuit to motor 19 thereby energizing the treadmill 11. Return lead 95 from motor 19 is grounded at 96.

Under such conditions where the user of the treadmill 11 trips, falls, or faints the safety harness strap 47, fragmentarily shown in FIG. 4, is extended creating a longitudinal pull upon cord 71 to retract the pull trap pin 69 of kill switch 67. This opens the kill switch 67 and shuts off the electrical power to the magnetic coil in the relay switch 85. This automatically opens the circuit 82 and deactivates treadmill motor 19.

The respective leads 105 and 107 from the transformer 87 to the kill switch 67 in FIG. 7 are enclosed by conduit 109, FIG. 1, which extends between the safety box 83 and the kill switch 67. The additional conduit 111 extends from the safety box 83, as in FIG. 1, and terminates in a female plug 113 adapted to receive the male plug 31 for delivering electrical power through conduit 29 to the treadmill motor 19.

Figure 8:
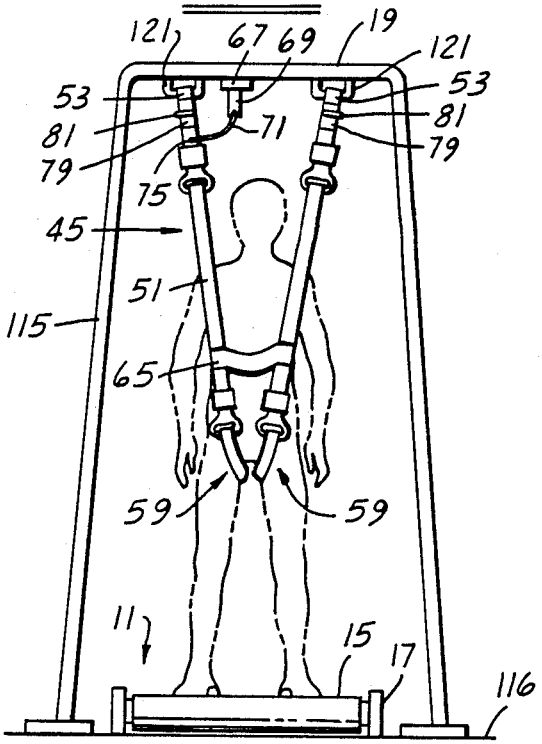
FIG. 8 is a front elevational view of a floor mounted frame for the safety harness assembly which straddles the treadmill in a normal use position corresponding to FIG. 2.
Figure 9:
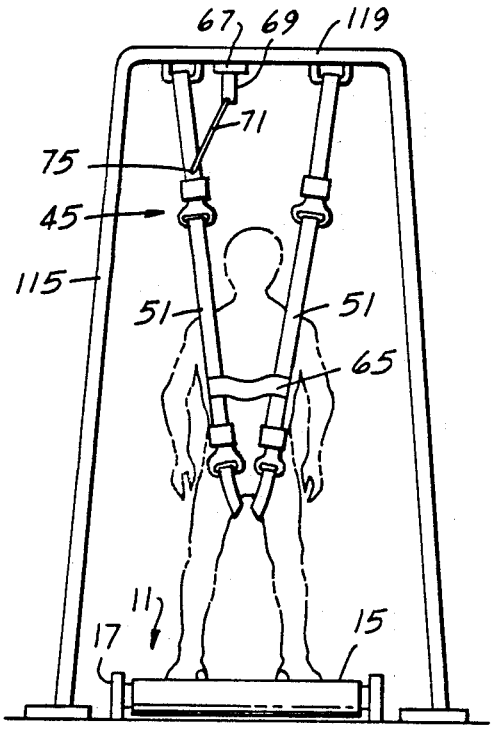
FIG. 9 is a similar view to FIG. 8, with the harness assembly extended.

FIGS. 8 and 9 illustrate a modified overhead support means for the safety harness 45 in the nature of a pair of spaced inverted U shaped frames 115 straddling the treadmill 15 and resting upon the floor surface 116.

Figure 10:
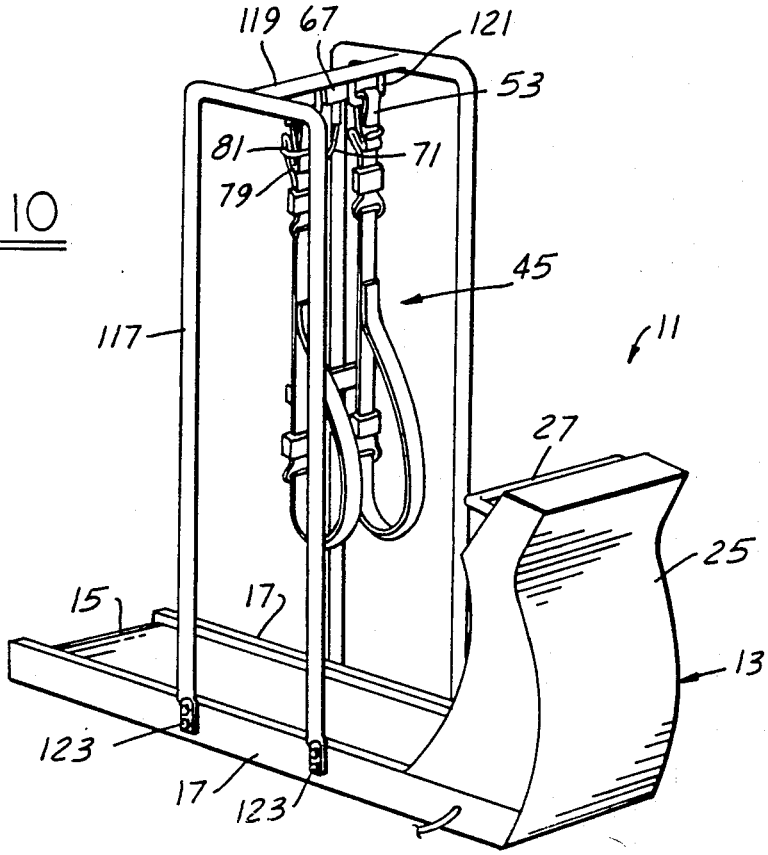
FIG. 10 is a perspective view of a modified harness frame work mounted upon the treadmill side rails.

A cross member 119 interconnects frame members 115 in the same manner as shown in the modified apparatus of FIG. 10. A pair of longitudinally spaced U brackets 121 depend from and are secured to the cross member 119 and are adapted to supportively receive the loops 53 located upon the upper ends of the upper strap portions 49 of the safety harness 45. The respective inverted U frames 115, of FIGS. 8 and 9, define the cross member 119 as a support member overlying the treadmill from which the safety harness 45 is flexibly and yieldably suspended.

The construction of the safety harness including the pleated portions 79 and spring clip 81, FIGS. 5 and 6, is the same in FIGS. 8 and 9. FIGS. 8 corresponds to the illustration in FIG. 2, being a normal use position with the safety straps unextended with the user free to walk, trot or run upon the treadmill surface. The cord 71 connects the kill switch pull trap pin 69 in the same manner as above described with respect to FIGS. 1 and 4–7. If the user faints or falls the pleats 79 are eliminated so that the safety straps lengthen and the cord 71 exerts a longitudinal force upon the retractable pull trap pin 69. This opens the kill switch 67 thereby shutting down the treadmill in the manner shown in FIG. 9, which corresponds to FIG. 3. In FIG. 9 the pleats 79 are shown eliminated due to the weight of the body of the user acting upon the safety harness 45.

A further modified support means is shown in FIG. 10. A pair of inverted U shaped frames 117 span the treadmill 11 and at their lower ends are secured at 123 to the corresponding side rails 17. The corresponding transverse cross member 119 interconnects the frames 117 at their upper ends and has a pair of longitudinally spaced U brackets 121 to support the upper ends of the respective straps of the safety harness 45. The operation is the same as described previously so that any extension of the safety harness 45 which eliminates the pleats shown at 79, FIG. 10, retracts the cord 71 and thereby opens the kill switch 67 shutting down the treadmill 11.

A modified ceiling mount 130 for the present safety harness on/off switch assembly is shown in FIGS. 11, 12 and 13. The ceiling mount 130 includes an overhead support means or mount box 125 which overlies the treadmill 11 and provides a support for the mount rings 147 which are located upon the safety harness 45.

The overhead support means or ceiling mount box 125 is made from aluminum or steel and is suitably secured to a ceiling or other support. Mount box 125 includes a base plate 127 having a pair of apertures 129. A pair of upright spacer sleeves 131 are secured upon base plate 127 concentric with the apertures 129 and loosely receive the threaded shanks 134 of eyebolts 133. A nut 135 is adjustably threaded over the upper ends of the shanks 134. Mounted upon each of the eyebolt shanks 134 is a washer 137. Coiled compression spring 139 surrounds the respective shanks 134 of the eyebolts 133 and is interposed between the base plate 127 and the corresponding washer 137. Mounted upon base plate 127 are a pair of laterally spaced normally closed on/off micro switches 143. Each micro switch 143 includes a movable contact arm 141, FIG. 12. Arms 41 are shown in a closed position, but in the path of downward movement of the corresponding washers 137.

The respective normally closed micro switches 143 are each connected into the electrical circuit in the same manner as above described with respect to kill switch 67 in FIG. 7. In the illustration in FIG. 12, the corresponding micro switches 143 are in a closed condition so that the magnetic coil of the relay switch 85 is energized and power is fed or directed to the treadmill motor 19.

In operation should the user faint, fall, trip or otherwise collapse such as to the position shown in FIGS. 3 and 9, then in that case additional stress is placed upon the safety harness 45 so that the upper ends thereof, through the harness support rings 147 operatively engage the eyebolts 133. The eyebolts 133 are retracted against the action of the corresponding springs 139 until washer 135 engages the corresponding micro switch retractable member 141 and moves it to the open position shown fragmentarily in FIG. 13. This deactivates the relay switch 85 and correspondingly shuts down the treadmill motor 19.

As shown in FIGS. 12 and 13, the corresponding micro switches 143 are anchored or retained upon the base plate 127 by corresponding mount flanges 145. Thus the coil springs 139 provide the yieldable suspension for safety harness 45 so that when that extra stress is applied to the harness 45 the eyebolts 133 through the rings 147 are drawn downwardly thereby compressing the springs 139. This opens the corresponding micro switches 143 in FIG. 13. Thus, the control means broadly defined as connected to the respective safety harness 45 in the illustration shown in FIGS. 11, 12 and 13 consist of the spring biased washers 137 normally spaced from the micro switch movable members 141 and adapted on downward extension of the safety harness 45 to open the respective micro switches 143 and deactivate the treadmill 11. Either of the micro switches 143 or both will de-energize the magnetic coil of the relay switch 85 to stop the treadmill 11.

Having described our invention reference should now be had to the claims which follow.

1. A safety harness on/off switch assembly for a motorized treadmill comprising a support means positioned over the treadmill;

a safety harness including a pair of spaced laterally interconnected straps, at their upper ends flexibly and yieldably suspended from said support means and at their lower ends including a pair of loops, said loops passing upwardly under the groin and over the shoulder of the user such that said harness does not support said person during operation of said treadmill but will function in response to collapse of the user to catch the user in a seated position;

an electrical circuit connected to the treadmill and adapted to be connected to a power source;

a normally closed safety switch means mounted upon said support means and interconnected in said circuit and including a movable member;

control means connected to at least one of the straps, on downward movement adapted to actuate said movable member, whereby when a user falls, trips, faints or is injured the body of the user rests upon said loops extending said straps and actuating said movable member thereby opening said switch means and deactivating the treadmill;

the treadmill including an electric motor connected into said circuit, whereby actuation of said movable member deactivates said electric motor;

said electrical circuit including a normal open relay switch connected to said motor and including a magnetic coil when energized adapted for closing said relay switch;

said switch means being connected to said magnetic coil for closing said relay switch and energizing said treadmill motor, actuation of said movable member opening said switch means, deactivating said relay and shutting down said treadmill.

2. In safety harness on/off switch assembly of claim 1, said circuit further including a step-down transformer connected to said power source providing a reduced voltage to said switch means for energizing said magnetic coil and closing said relay switch.

3. In the safety harness on/off switch assembly of claim 2, said transformer being selectively 110 and 220 volts, the step-down voltage being 24 volts.

4. In the safety harness on/off switch assembly of claim 2, a housing enclosing said relay switch, transformer and electrical circuit and including a first electrical conduit extending therefrom and adapted for connection to the power source, a second electrical conduit extending therefrom connecting said relay switch with said treadmill, and a third conduit for connecting said transformer to said switch means.

5. A safety harness on/off switch assembly for a motorized treadmill comprising a support means positioned over the treadmill;

a safety harness including a pair of spaced laterally interconnected straps, at their upper ends flexibly and yieldably suspended from said support means and at their lower ends including a pair of loops, said loops passing upwardly under the groin and over the shoulder of the user such that said harness does not support said person during operation of said treadmill but will function in response to collapse of the user to catch the user in a seated position;

an electrical circuit connected to the treadmill and adapted to be connected to a power source;

a normally closed safety switch means mounted upon said support means and interconnected in said circuit and including a movable member;

control means connected to at least one of the straps, on downward movement adapted to actuate said movable member, whereby when a user falls, trips, faints or is injured the body of the user rests upon said loops extending said straps and actuating said movable member thereby opening said switch means and deactivating the treadmill;

said support means including a tubular mount box having an apertured bottom wall adapted for connection to a ceiling;

said yieldable suspension of said straps including a pair of laterally spaced eye bolts depending from said mount box receiving the upper ends of said straps;

each eye bolt including a threaded shank extending through said bottom wall into said box;

a fastener threaded over said shank retaining a washer thereon; and a coiled compression spring receiving said shank interposed in compression between said washer and bottom wall;

said switch means including a normally closed on/off micro switch mounted upon said bottom wall interconnected in said circuit including a movable member spaced from said washer;

said control means including said washer whereby when a user falls, the weight of the body of the user upon said straps moves said eye bolts and washers with at least one washer engaging and retracting said movable member.

6. In the safety harness on/off switch assembly of claim 5, a spacer sleeve within said spring mounted upon said bottom wall and receiving said eye bolt shank limiting downward movement of said washer.

7. In the safety harness on/off switch assembly of claim 5, said switch means including a second normally closed on/off micro switch mounted upon said bottom wall interconnected in said circuit and including a movable member spaced from the other of said washers, whereby either of said micro switches will deactivate the treadmill.

* * * * *